US009915056B2

(12) United States Patent
Tanaka et al.

(10) Patent No.: US 9,915,056 B2
(45) Date of Patent: Mar. 13, 2018

(54) LIQUID-PRESSURE DRIVE SYSTEM AND CONSTRUCTION MACHINE INCLUDING SAME

(71) Applicants: KABUSHIKI KAISHA KCM, Kako-gun, Hyogo (JP); HITACHI CONSTRUCTION MACHINERY CO., LTD., Tokyo (JP)

(72) Inventors: Shinichiro Tanaka, Kakogawa (JP); Hiroyasu Kodera, Kobe (JP)

(73) Assignee: KABUSHIKI KAISHA KCM, Kako (JP)

( * ) Notice: Subject to any disclaimer, the term of this patent is extended or adjusted under 35 U.S.C. 154(b) by 297 days.

(21) Appl. No.: 14/646,193

(22) PCT Filed: Nov. 19, 2013

(86) PCT No.: PCT/JP2013/006800
§ 371 (c)(1),
(2) Date: Aug. 3, 2015

(87) PCT Pub. No.: WO2014/080619
PCT Pub. Date: May 30, 2014

(65) Prior Publication Data

US 2015/0330059 A1 Nov. 19, 2015

(30) Foreign Application Priority Data

Nov. 20, 2012 (JP) ..... 2012-254235

(51) Int. Cl.
*F15B 13/00* (2006.01)
*E02F 9/22* (2006.01)
(Continued)

(52) U.S. Cl.
CPC ..... *E02F 9/2242* (2013.01); *E02F 9/225* (2013.01); *E02F 9/226* (2013.01); *E02F 9/2282* (2013.01);
(Continued)

(58) Field of Classification Search
CPC ..... F15B 21/042; F15B 2211/40553; F15B 2211/40561; F15B 2211/40569; F15B 2211/61; E02F 9/2242; E02F 9/226
(Continued)

(56) References Cited

U.S. PATENT DOCUMENTS 6,276,133 B1 8/2001 Yoshida et al.
2005/0217260 A1* 10/2005 Desjardins ..... F16D 31/02 60/421
(Continued)

FOREIGN PATENT DOCUMENTS

JP H10-61608 A 3/1998
JP 2000-087904 A 3/2000
(Continued)

OTHER PUBLICATIONS

JP2007046761 eSpacenet Machine Translation.*
Dec. 17, 2013 International Search Report issued in International Patent Application No. PCT/JP2013/006800.

*Primary Examiner* — Thomas E Lazo
*Assistant Examiner* — Dustin T Nguyen
(74) *Attorney, Agent, or Firm* — Oliff PLC

(57) ABSTRACT

In a hydraulic drive system, hydraulic oil discharged from an actuator pump is supplied to an actuator via an actuator drive circuit. In the hydraulic drive system, the hydraulic oil discharged from a fan pump is supplied to a cooling fan motor via a fan drive circuit, and the cooling fan motor rotates a cooling fan at a rotational speed corresponding to the flow rate of the hydraulic oil supplied to the cooling fan
(Continued)

motor. A merge circuit connects the actuator drive circuit and the fan drive circuit to each other to cause the hydraulic oil flowing through the actuator drive circuit to merge into the hydraulic oil flowing through the fan drive circuit. When the merge condition is satisfied, the controller controls the merge circuit to connect the actuator drive circuit and the fan drive circuit to each other.

8 Claims, 4 Drawing Sheets

(51) Int. Cl.
*F15B 11/17* (2006.01)
*F15B 1/00* (2006.01)
*F15B 11/02* (2006.01)

(52) U.S. Cl.
CPC ..... *E02F 9/2285* (2013.01); *E02F 9/2292* (2013.01); *E02F 9/2296* (2013.01); *F15B 1/00* (2013.01); *F15B 11/02* (2013.01); *F15B 11/17* (2013.01); *F15B 2211/20523* (2013.01); *F15B 2211/20538* (2013.01); *F15B 2211/20546* (2013.01); *F15B 2211/20553* (2013.01); *F15B 2211/20576* (2013.01); *F15B 2211/30595* (2013.01); *F15B 2211/633* (2013.01); *F15B 2211/6343* (2013.01); *F15B 2211/6346* (2013.01); *F15B 2211/7135* (2013.01); *F15B 2211/7142* (2013.01); *F15B 2211/781* (2013.01)

(58) Field of Classification Search
USPC ..... 60/420, 421, 422, 456, 295, 296, 298, 60/297, 311, 320
See application file for complete search history.

(56) References Cited

U.S. PATENT DOCUMENTS

| | | | | |
|---|---|---|---|---|
| 2007/0169474 | A1 | 7/2007 | Oka et al. | |
| 2010/0303643 | A1* | 12/2010 | Kataoka | E02F 9/2203 417/213 |
| 2011/0011076 | A1* | 1/2011 | Tanaka | E02F 9/2228 60/396 |
| 2012/0000191 | A1* | 1/2012 | Hagiwara | B01D 46/0063 60/311 |
| 2012/0227379 | A1* | 9/2012 | Koestler | F01N 3/023 60/274 |
| 2012/0279203 | A1* | 11/2012 | Arai | B01D 53/944 60/276 |
| 2013/0318953 | A1* | 12/2013 | Geissler | B60K 11/00 60/384 |
| 2014/0033693 | A1* | 2/2014 | Nelson | F16D 31/00 60/327 |

FOREIGN PATENT DOCUMENTS

| | | | | |
|---|---|---|---|---|
| JP | 2000-161233 A | | 6/2000 | |
| JP | 2007-046761 A | | 2/2007 | |
| JP | 2007046761 | * | 2/2007 | F15B 21/00 |
| JP | 2007-192344 A | | 8/2007 | |

* cited by examiner

LIQUID-PRESSURE DRIVE SYSTEM AND CONSTRUCTION MACHINE INCLUDING SAME

TECHNICAL FIELD

The present invention relates to a liquid-pressure (hydraulic) drive system which supplies pressurized liquid to drive an actuator and a cooling fan, and a construction machine including same.

BACKGROUND ART

A construction machine or the like includes a cooling fan which rotates to supply air to a radiator to cool the radiator. As a driving source for the cooling fan, for example, a hydraulic motor is used. The hydraulic motor is configured to receive pressurized oil supplied from a hydraulic drive device and rotate the cooling fan. As one example of such a hydraulic drive device, a hydraulic drive cooling fan device disclosed in Patent Literature 1 is known.

The hydraulic drive cooling fan device disclosed in Patent Literature 1 includes a pilot pump and a steering pump. The pilot pump is configured to discharge pressurized oil for a pilot pressure to a pilot circuit. The steering pump is a variable displacement pump which changes the flow rate of the discharged oil, depending on the water temperature of the radiator. The steering pump is configured to supply the pressurized oil to a steering via a steering circuit. The steering circuit is divided at a point and merges into the pilot circuit. The steering circuit and the pilot circuit constitute a merge circuit. The merge circuit is connected to a hydraulic motor, which receives a hydraulic pressure from the merge circuit, thereby rotating the cooling fan.

In the hydraulic drive cooling fan device configured as described above, when the water temperature of the radiator is low, the oil is discharged from the steering pump at a low flow rate and the cooling fan is rotated at a low speed so that the water temperature of the radiator is increased. On the other hand, when the water temperature of the radiator is high, the oil is discharged from the steering pump at a high flow rate and the cooling fan is rotated at a high speed so that the water temperature of the radiator is decreased.

CITATION LIST

Patent Literature

Patent Literature 1: Japanese Laid-Open Patent Application Publication No. Hei. 2000-161233

SUMMARY OF INVENTION

Technical Problem

In the hydraulic drive cooling fan device disclosed in Patent Literature 1, the pilot pump and the steering pump are driven by a diesel engine. The diesel engine burns an air-fuel mixture of fuel and air to generate an exhaust gas, and emits this exhaust gas to atmospheric air through a muffler. The exhaust gas contains particulate matters (hereinafter will be simply referred to as "PM"), such as soot. To collect the PM, a diesel particulate filter (hereinafter will be simply referred to as "DPF") is provided inside of the muffler.

If the DPF continues to collect the PM, it will get clogged with the PM. To avoid this, it is necessary to increase the temperature of the exhaust gas to burn and remove the PM so that the DPF is regenerated. The DPF may be regenerated by, for example, increasing the load torque of an engine in an idling state in which an actuator such as the steering is not operated, i.e., applying a load to the engine to increase the temperature of the exhaust gas.

The hydraulic drive cooling fan device disclosed in Patent Literature 1 is intended to adjust the water temperature of the radiator by using the two pumps. In this device, during high-speed running of the engine, the flow rate of the pressurized oil flowing through the merge circuit is increased to enhance the cooling capability of the cooling fan, thereby preventing an increase in the water temperature of the radiator. On the other hand, during low-speed running of the engine, the flow rate of the pressurized oil flowing through the merge circuit is decreased to reduce the maximum rotational speed of the cooling fan, thereby preventing the radiator from being cooled excessively. In other words, when an engine speed is low, for example, during the idling state, the cooling capability of the cooling fan is set low. When the water temperature of the radiator exceeds a permissible value, the engine is overheated, and therefore it becomes necessary to interrupt the regeneration of the DPF. For this reason, if the cooling capability of the cooling fan is set low, a temperature increase in the radiator is facilitated, so that the PM cannot be removed sufficiently.

In view of the above, an object of the present invention is to provide a liquid-pressure drive system which allows the cooling capability of a cooling fan to be enhanced to a higher level by a cooling fan drive device, when a predetermined condition is met.

Solution to Problem

The present invention provides a liquid-pressure drive system comprising: a first liquid-pressure pump which discharges pressurized liquid; an actuator drive circuit which flows the pressurized liquid discharged from the first liquid-pressure pump to an actuator to drive the actuator; a liquid-pressure motor which rotates a cooling fan at a rotational speed corresponding to a flow rate of the pressurized liquid supplied to the liquid-pressure motor; a second liquid-pressure pump which discharges the pressurized liquid in response to an operation of the first liquid-pressure pump; a fan drive circuit which flows the pressurized liquid discharged from the second liquid-pressure pump to the liquid-pressure motor to drive the liquid-pressure motor; a merge circuit which performs switching to connect the actuator drive circuit and the fan drive circuit to each other or to disconnect the actuator drive circuit and the fan drive circuit from each other, and causes the pressurized liquid flowing through the actuator drive circuit to merge into the pressurized liquid flowing though the fan drive circuit in a state in which the actuator drive circuit and the fan drive circuit are connected to each other; and a controller which controls the merge circuit to connect the actuator drive circuit and the fan drive circuit to each other, when a predetermined merge condition is satisfied.

In accordance with the present invention, when the predetermined merge condition is satisfied, the controller causes the merge circuit to connect the actuator drive circuit and the fan drive circuit to each other, and the pressurized liquid flowing through the actuator drive circuit merges into the pressurized liquid flowing through the fan drive circuit. In this configuration, the pressurized liquid flowing through the actuator drive circuit as well as the pressurized liquid discharged from the second liquid-pressure pump can be supplied to the fan drive circuit, and the cooling fan can be driven at a rotational speed which is equal to or higher than a maximum rotational speed which can be driven by the second liquid-pressure pump. In other words, when the predetermined merge condition is satisfied, the cooling function of the cooling fan can be enhanced to a higher level.

In the above invention, the merge circuit may include an on-off switch valve, and a pressure compensation flow rate limiting means, the controller may output a connection command depending on whether or not the predetermined merge condition is satisfied, the on-off switch valve may perform switching to connect the actuator drive circuit and the fan drive circuit to each other or to disconnect the actuator drive circuit and the fan drive circuit from each other, in response to the connection command received from the controller, and the pressure compensation flow rate limiting means may limit the flow rate of the pressurized liquid which flows from the actuator drive circuit into the fan drive circuit such that the pressurized liquid flowing through the actuator drive circuit merges into the pressurized liquid flowing through the fan drive circuit, while ensuring a predetermined flow rate of the pressurized liquid flowing though the actuator drive circuit.

In accordance with this configuration, it becomes possible to prevent a decrease in the pressure of the pressurized liquid flowing through the actuator drive circuit when the pressurized liquid flowing through the actuator drive circuit merges into the pressurized liquid flowing through the fan drive circuit. This makes it possible to increase the maximum rotational speed of the cooling fan while allowing the actuator drive circuit to perform the function.

In the above invention, the on-off switch valve may be an electromagnetic on-off valve which performs switching to connect the actuator drive circuit and the fan drive circuit to each other or to disconnect the actuator drive circuit and the fan drive circuit from each other, in response to the connection command.

In accordance with this configuration, the merge circuit can be realized with fewer components.

In the above invention, the liquid-pressure drive system may further comprise an electromagnetic control valve which outputs a pilot pressure in response to the connection command; the on-off switch valve may be a logic valve or a spool valve which performs switching to connect the actuator drive circuit and the fan drive circuit to each other or to disconnect the actuator drive circuit and the fan drive circuit from each other, in response to the pilot pressure output from the electromagnetic control valve.

In accordance with this configuration, since the valve placed between the actuator drive circuit through which the pressurized liquid flows at a high flow rate and a high pressure, and the fan drive circuit, is the spool valve or the logic valve, manufacturing cost can be reduced as compared to a case where the electromagnetic on-off valve is used as the valve placed between the actuator drive circuit and the fan drive circuit.

In the above invention, a pressure source of the pilot pressure may be the pressurized liquid flowing through the actuator drive circuit.

In accordance with this configuration, since the actuator drive circuit can ensure the pressure source of the pilot pressure, an increase in the number of components does not occur.

A pressure source of the pilot pressure may be the pressurized liquid discharged from a pilot pump, and a discharge pressure of the pilot pump may be lower than a discharge pressure of the first liquid-pressure pump.

In accordance with this configuration, since the pressurized liquid discharged from the pilot pump is the pilot pressure source, the electromagnetic control valve may be a valve having a lower pressure resistance. Therefore, manufacturing cost can be reduced.

In the above invention, the liquid-pressure drive system may comprise a temperature detector which detects a temperature of a cooled target to be cooled by the cooling fan, and the controller may be configured to determine that the merge condition is satisfied, when the temperature detected by the temperature detector exceeds a first predetermined temperature.

In accordance with this configuration, it becomes possible to prevent a situation in which the cooled target is cooled insufficiently and thereby the operation performance of the cooled target is degraded.

In the above invention, the controller may be configured to determine that the merge condition is not satisfied and disconnects the actuator drive circuit and the fan drive circuit from each other, when the temperature detected by the temperature detector is decreased from the first predetermined temperature to a value which is equal to or lower than a second predetermined temperature.

In accordance with this configuration, it becomes possible to prevent a situation in which the cooled target is cooled excessively and thereby the operation performance of the cooled target is degraded.

In the above invention, the liquid-pressure drive system may comprise: an engine which drives the first liquid-pressure pump and the second liquid-pressure pump; a filter which captures particulate matters contained in an exhaust gas emitted from the engine; and an input device operated to input a regeneration command to regenerate the filter, wherein the cooled target may be a cooling medium for cooling at least one of the engine and the pressurized liquid, the actuator drive circuit may include a relief valve which discharges the pressurized liquid flowing through the actuator drive circuit to a tank when a pressure of the pressurized liquid reaches a predetermined pressure, and may be configured to perform switching to a loaded state in which the actuator drive circuit disconnects the first liquid-pressure pump and the actuator from each other and the pressurized liquid discharged from the first liquid-pressure pump is discharged to the tank via the relief valve, and the controller may be configured to perform switching to place the actuator drive circuit in the loaded state, when the engine speed is equal to or lower than a predetermined engine speed and the controller receives the regeneration command from the input device.

In accordance with this configuration, when the regeneration command is input by operating the input device and the actuator drive circuit is turned to the loaded state, the temperature of the exhaust gas emitted from the engine is increased and the filter can be regenerated in such a manner that the particulate matters captured in the filter are burned. In this case, since the actuator drive circuit is placed in the loaded state, a load is applied to the engine, so that the temperature of the cooling medium is increased. Since the merge circuit causes the pressurized liquid discharged from the first liquid-pressure pump to merge into the pressurized liquid flowing through the fan drive circuit, the maximum rotational speed of the cooling fan can be increased to a larger one. As a result, the cooling function of the cooling fan can be enhanced and an increase in the temperature of the cooling medium can be suppressed. In this way, the filter can be regenerated suitably.

A construction machine of the present invention may include any one of the above-described liquid-pressure drive systems.

In accordance with the present invention, the construction machine which can achieve the above-described function can be realized.

Advantageous Effects of Invention

In accordance with the present invention, the cooling capability of a cooling fan driven by a cooling fan drive device can be enhanced to a higher level, when a predetermined condition is satisfied.

The above and further objects, features and advantages of the present invention will more fully be apparent from the following detailed description of preferred embodiments with accompanying drawings.

DESCRIPTION OF EMBODIMENTS

Hereinafter, hydraulic drive systems 1, 1A, 1B according to the embodiments of the present invention will be described with reference to the drawings. In the embodiments, the stated directions are from the perspective of a driver of a wheel loader which will be described later. The directions are used for easier understanding of the description, and are not intended to limit the directions and the like of the components of the invention to the described directions. Also, the hydraulic drive systems 1, 1A, 1B described below are merely the embodiments of the present invention. Therefore, the present invention is not limited to the embodiments, and can be added, deleted and changed within a scope of the invention.

[Embodiment 1]

[Hydraulic Drive System]

Figure 1:
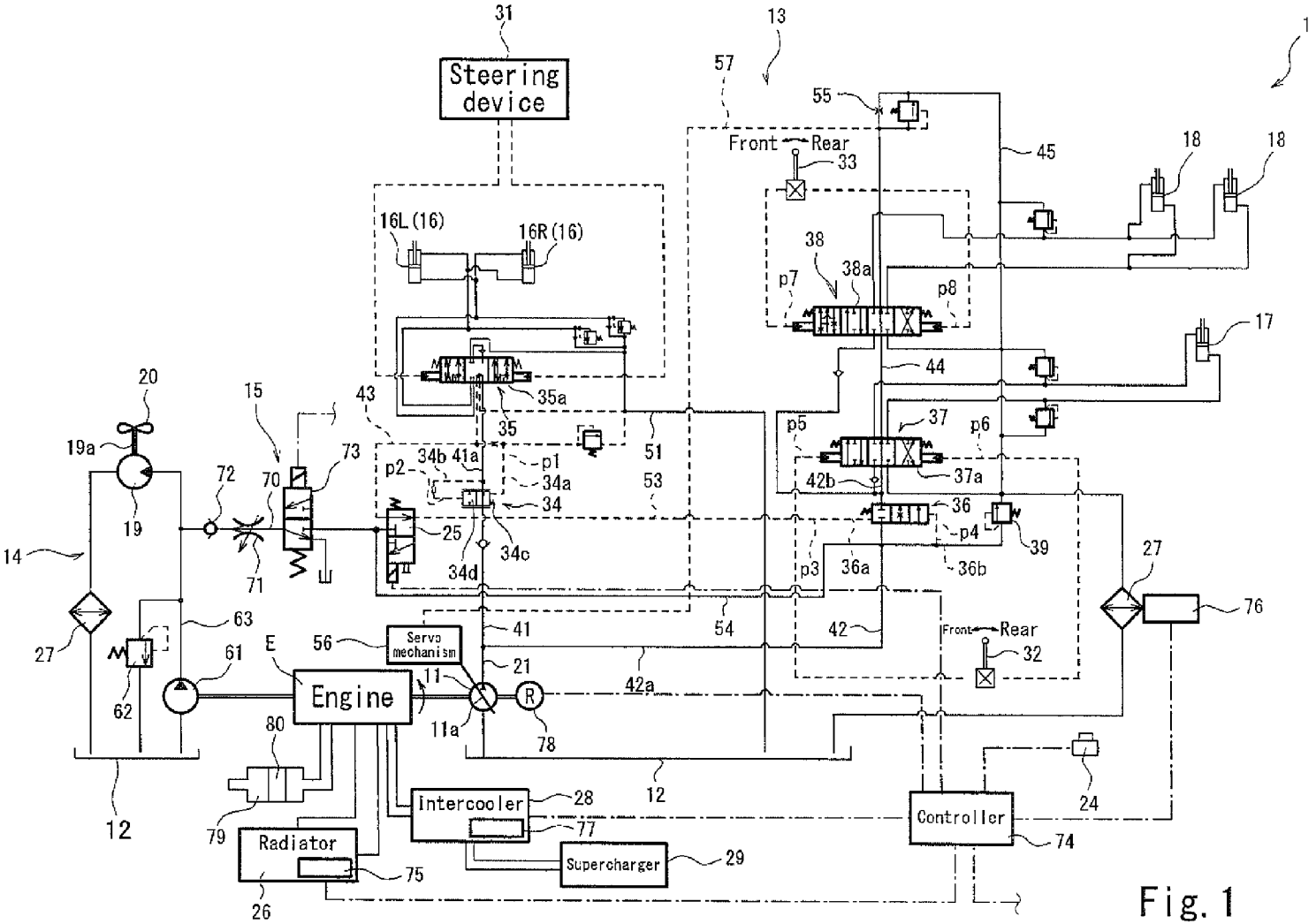
FIG. 1 is a circuit diagram showing a hydraulic circuit of a hydraulic drive system according to Embodiment 1 of the present invention.

A hydraulic drive system 1 according to Embodiment 1 of the present invention is mounted in a construction machine such as a wheel loader. As shown in FIG. 1, the wheel loader includes a pair of actuators for a steering (steering actuators) 16L, 16R, an actuator for a bucket (bucket actuator) 17, a pair of actuators for a hoist (hoist actuators) 18, and a motor for a cooling fan (cooling fan motor) 19. The hydraulic drive system 1 is able to drive the actuators 16 to 18 to bend a vehicle body, to actuate the bucket and the hoist, and further drive a cooling fan 20 which will be described later. As shown in FIG. 1, the hydraulic drive system 1 configured as described above basically includes a pump for the actuator (actuator pump) 11, an actuator drive circuit 13, a pump for a fan (fan pump) 61, a fan drive circuit 14, and a merge circuit 15.

[Actuator Pump]

The actuator pump 11 which is a first liquid-pressure pump is a variable displacement pump, for example, a swash plate pump. The actuator pump 11 is able to change the tilt angle of a swash plate 11*a* by a servo mechanism 56 which will be described later, and thereby change the flow rate of the discharged hydraulic oil. The output shaft of an engine E is coupled to the actuator pump 11 via a gear mechanism. When the engine E is run to rotate the output shaft thereof, the actuator pump 11 suctions hydraulic oil from inside of the tank 12, compresses the hydraulic oil, and discharges the compressed hydraulic oil. A main passage 21 of the actuator drive circuit 13 is connected to the discharge port of the actuator pump 11.

[Actuator Drive Circuit]

When a steering device 31, a lever for the bucket (bucket lever) 32, or a lever for the hoist (hoist lever) 33 is operated, the actuator drive circuit 13 flows the hydraulic oil discharged from the actuator pump 11 to one of the actuators 16 to 18 corresponding to the operation of the lever, to drive the corresponding one of the actuators 16 to 18. When the steering device 31 is operated, the actuator drive circuit 13 preferentially flows the hydraulic oil through the steering actuators 16 to preferentially drive the steering actuators 16. In a state in which the steering device 31, the bucket lever 32, and the hoist lever 33 are not operated, the actuator drive circuit 13 returns the hydraulic oil discharged from the actuator pump 11 to the tank 12. This allows the actuator pump 11 to be unloaded. Now, the configuration of the actuator drive circuit 13 will be described in more detail.

The actuator drive circuit 13 includes the main passage 21, a meter-in compensator 34, a direction control valve for the steering (steering direction control valve) 35, an electromagnetic switch valve 25, a bleed-off compensator 36, a direction control valve for the bucket (bucket direction control valve) 37, a direction control valve for the hoist (hoist control valve) 38, and a relief valve at a loading device side (loading device relief valve) 39. The main passage 21 is divided into a main passage at the steering side (steering main passage) 41 and a main passage at the loading device side (loading device main passage) 42, at a downstream side. The meter-in compensator 34 is provided at a steering main passage 41.

The meter-in compensator 34 is a pilot-type on-off valve including two pilot passages 34*a*, 34*b*. The first pilot passage 34*a* is connected to a communication passage 43 which will be described later. The second pilot passage 34*b* is connected to a portion (hereinafter will be simply referred to as "downstream portion") 41*a* of the steering main passage 41 which is downstream of the meter-in compensator 34. The first pilot passage 34*a* and the second pilot passage 34*b* are placed such that a first pilot pressure p1 of the first pilot passage 34*a* and a second pilot pressure p2 of the second pilot passage 34*b* act against each other.

The meter-in compensator 34 includes a spring member 34*c* which is placed such that its biasing force acts against the second pilot pressure p2. The meter-in compensator 34 configured in this way performs switching between ON and OFF depending on the balance among the biasing force of the spring member 34*c* and the two pilot pressures p1, p2. Depending on the balance between these forces, a portion of the steering main passage 41 which is upstream of the meter-in compensator 34 and the downstream portion 41*a* are connected to each other or disconnected from each other. The steering direction control valve 35 is connected to the downstream portion 41*a* of the steering main passage 41.

The steering direction control valve 35 is connected to the pair of steering actuators 16L, 16R. The pair of steering actuators 16L, 16R are a cylinder mechanism. The steering actuators 16L, 16R are placed at a left side and a right side, respectively and between a rear chassis and a front chassis, and coupled to the rear chassis and the front chassis. The steering direction control valve 35 is configured to control the flow direction and flow rate of the hydraulic oil to be flowed through the pair of steering actuators 16L, 16R.

More specifically, the steering direction control valve 35 includes a spool 35*a*. When the steering is rotated to a left or to a right, the spool 35*a* is moved to change the flow direction of flow rate of the hydraulic oil. More specifically, when the steering is rotated to the left, the spool 35*a* is moved to a first off-set position and the hydraulic oil is flowed through the pair of steering actuators 16L, 16R to change the direction of the wheel loader to the left. On the other hand, when the steering is rotated to the right, the spool 35*a* is moved to a second off-set position and the hydraulic oil is flowed through the pair of steering actuators 16L, 16R to change the direction of the wheel loader to the right. Or, when the spool 35*a* is returned to a neutral position, the downstream portion 41*a* of the steering main passage 41 is in communication with the tank 12, and the steering main passage 41 and the pair of steering actuators 16L, 16R are disconnected from each other. In this way, the pair of steering actuators 16L, 16R are maintained in an extended or contracted state.

The communication passage 43 is further connected to the steering direction control valve 35 configured as described above. The first pilot passage 34*a* of the meter-in compensator 34 is connected to the communication passage 43. The communication passage 43 is in communication with a tank line 51 connected to the tank 12 in the interior of the spool 35*a*, when the spool 35*a* is in the neutral position. In a state in which the communication passage 43 is in communication with the tank line 51, the first pilot pressure p1 is equal to a tank pressure. In contrast, the second pilot passage 34*b* is connected to the downstream portion 41*a* of the steering main passage 41, and the second pilot pressure p2 is a discharge pressure from the actuator pump 11. Thereby, the meter-in compensator 34 closes the steering main passage 41.

In contrast, when the spool 35*a* is moved to the first off-set position or the second off-set position, the communication passage 43 is disconnected from the tank line 51 in the interior of the spool 35*a*, and connected to the downstream portion 41*a*. This causes the first and the second pilot pressures p1, p2 to be substantially equal. The meter-in compensator 34 biased by the spring member 34*c* opens the steering main passage 41. In this way, the meter-in compensator 34 opens or closes the steering main passage 41, depending on the pilot pressures p1, p2 of the first and second pilot passages 34*a*, 34*b*. The electromagnetic switch valve 25 is connected to the communication passage 43 through which the pilot pressure p1 is guided to the first pilot passage 34*a*.

The electromagnetic switch valve 25 is connected to a first bypass passage 53 and a second bypass passage 54 in addition to the communication passage 43. The electromagnetic switch valve 25 performs switching to connect the first bypass passage 53 to the communication passage 43 or to the second bypass passage 54, in response to a command provided to the electromagnetic switch valve 25. The first bypass passage 53 is connected to the bleed-off compensator 36.

The bleed-off compensator 36 is a pilot-type flow control valve including two pilot passages 36*a*, 36*b*. The bleed-off compensator 36 is provided on the loading device main passage 42. The bleed-off compensator 36 is configured to control the flow rate of the hydraulic oil flowing through the bleed-off compensator 36, depending on a difference between a third pilot pressure p3 of the hydraulic oil flowing through the pilot passage 36*a* and a fourth pilot pressure p4 flowing through the pilot passage 36*b*. The third pilot passage 36*a* is connected to the communication passage 43 via the first bypass passage 53. The pressurized oil with a pressure equal to the first pilot pressure p1 is guided to the third pilot passage 36*a*. In contrast, the fourth pilot passage 36*b* is connected to a portion (hereinafter will be simply referred to as "upstream portion") 42*a* of the loading device main passage 42 which is upstream of the bleed-off compensator 36. In addition, the bucket direction control valve 37 is connected to a portion (hereinafter will be simply referred to as "downstream portion") 42*b* of the loading device main passage 42 which is downstream of the bleed-off compensator 36.

The bucket direction control valve 37 is connected to the bucket actuator 17. The bucket direction control valve 37 is configured to change the flow direction of the hydraulic oil flowing through the bucket actuator 17, depending on a pilot pressure p5 or a pilot pressure p6 output in response to the displacement of the bucket lever 32 operated by the driver to a front or to a rear. The bucket actuator 17 is a cylinder mechanism, and is extendable and contractible depending on the flow direction of the hydraulic oil with respect to the bucket actuator 17. When the bucket actuator 17 extends or contracts, the bucket is lifted up or lowered down.

More specifically, when the bucket lever 32 is operated, the bucket direction control valve 37 flows the hydraulic oil discharged from the actuator pump 11 to the bucket actuator 17. On the other hand, when the bucket lever 32 is returned to the neutral position, the bucket direction control valve 37 returns a spool 37*a* to the neutral position to connect the loading device main passage 42 and the hoist passage 44, thus flowing the hydraulic oil discharged from the actuator pump 11 to the hoist passage 44. The hoist direction control valve 38 is connected to the hoist passage 44. The hydraulic oil flowing through the hoist passage 44 is guided to the hoist direction control valve 38.

The hoist direction control valve 38 is connected to the pair of hoist actuators 18. The hoist direction control valve 38 is configured to change the flow direction of the hydraulic oil flowing through the pair of hoist actuators 18, depending on a pilot pressure p7 or a pilot pressure p8 output in response to the displacement of the hoist lever 33 operated by the driver to a front or to a rear. The pair of hoist actuators 18 are a cylinder mechanism, and are extendable and contractible depending on the flow direction of the hydraulic oil with respect to the pair of hoist actuators 18. When the pair of hoist actuators 18 are extended or contracted, the bucket is vertically moved.

More specifically, when the hoist lever 33 is operated, the hoist direction control valve 38 flows the hydraulic oil discharged from the actuator pump 11 to the pair of hoist actuators 18. On the other hand, when the hoist lever 33 is returned to the neutral position, the hoist direction control valve 38 returns a spool 38*a* to the neutral position to connect the hoist passage 44 and the tank passage 45 to each other, thus flowing the hydraulic oil discharged from the actuator pump 11 to the tank passage 45. The tank 12 is connected to the tank passage 45. The hydraulic oil flowing through the tank passage 45 is discharged to the tank 12.

The tank passage 45 is provided with a throttle 55. The region of the tank passage 45 which is upstream of the throttle 55 is connected to the servo mechanism 56 via a servo passage 57. The throttle 55 is configured to generate a pressure in the region upstream of the throttle 55, with respect to the hydraulic oil returned to the tank 12 via the tank passage 45. This pressure is input to the servo mechanism 56 via the servo passage 57. The servo mechanism 56 changes the tilt angle of the swash plate 11 a of the actuator pump 11, and changes the flow rate of the hydraulic oil discharged from the actuator pump 11, based on the pressure input to the servo mechanism 56. When the input pressure is high, the servo mechanism 56 decreases the tilt angle of the swash plate 11*a* and decreases the flow rate of the hydraulic oil discharged from the actuator pump 11. On the other hand, when the input pressure is low, the servo mechanism 56 increases the tilt angle of the swash plate 11*a* and increases the flow rate of the hydraulic oil discharged from the actuator pump 11. In this way, the hydraulic oil is guided from the actuator pump 11 to the loading device main passage 42, at a flow rate corresponding to the operation amount of the bucket lever 32 or the operation amount of the hoist lever 33.

The loading device relief valve 39 is connected to the upstream portion 42*a* of the loading device main passage 42. When the pressure of the hydraulic oil flowing through the loading device main passage 42 reaches a value equal to or higher than a predetermined pressure, the loading device relief valve 39 is opened, and the hydraulic oil is discharged from the loading device main passage 42 to the tank 12 via the tank passage 45. The second bypass passage 54 is connected to the upstream portion 42*a* of the loading device main passage 42. As described above, the second bypass passage 54 is connected to the electromagnetic switch valve 25. The fan drive circuit 14 is connected to the second bypass passage 54 via the merge circuit 15. A fan pump 61 is connected to the fan drive circuit 14.

[Fan Pump]

The fan pump 61 which is a second liquid-pressure pump is a fixed displacement pump. The discharge port of the fan pump 61 is connected to the fan drive circuit 14. Like the actuator pump 11, the fan pump 61 is connected in series with or in parallel with the output shaft of the engine E, via a gear mechanism. Although in the example of FIG. 1, the two pumps 11, 61 are placed at both sides of the engine E for easier understanding of the description, they may be connected in series with or in parallel with the output shaft of the engine E, at one side of the engine E. The fan pump 61 connected in this way operates in response to the operation of the actuator pump 11. According to the rotation of the output shaft of the engine E, the fan pump 61 suctions the hydraulic oil from inside of the tank 12, compresses the hydraulic oil and discharges the compressed hydraulic oil to the fan drive circuit 14.

[Fan Drive Circuit]

The fan drive circuit 14 flows the hydraulic oil discharged from the fan pump 61 to the cooling fan motor 19, to rotate the cooling fan motor 19. The cooling fan 20 is attached to the output shaft 19*a* of the cooling fan motor 19 which is a liquid-pressure motor. The cooling fan 20 is rotatable in response to the rotation of the cooling fan motor 19. The cooling fan 20 is disposed to face cooled targets (targets to be cooled). The cooling fan 20 rotates to send air to the cooled targets to cool the cooled targets.

In the present embodiment, the cooled targets may include the radiator 26, an oil cooler 27, and an intercooler 28. A coolant circulated through the interior of the engine E is guided to the radiator 26. The hydraulic oil flowing through the actuator drive circuit 13 and the fan drive circuit 14 is guided to the oil cooler 27. The intercooler 28 is configured to cool compressed air sent from a supercharger 29 to the engine E. In the present embodiment, the cooled targets include three devices. However, all of the three devices need not be the cooled targets. At least one of the radiator 26, the oil cooler 27, and the intercooler 28 may be the cooled target. Further, the cooled targets may include devices other than the radiator 26, the oil cooler 27, and the intercooler 28. For example, the cooled targets may include an oil cooler for transmission oil, for cooling the transmission oil flowing through a transmission (not shown). Now, the configuration of the fan drive circuit 14 will be described in more detail.

The fan drive circuit 14 includes a fan relief valve 62 and a fan passage 63. The fan passage 63 is connected to the discharge port of the fan pump 61. The fan passage 63 is also connected to the suction port of the cooling fan motor 19. The hydraulic oil discharged from the fan pump 61 is supplied to the cooling fan motor 19 via the fan passage 63. The fan relief valve 62 is connected to the fan passage 63. When the pressure of the hydraulic oil flowing through the fan passage 63 reaches a value equal to or higher than a predetermined pressure, the fan relief valve 62 connects the fan passage 63 and the tank 12 to each other, thereby discharging a part of the hydraulic oil flowing through the fan passage 63 to the tank 12.

Figure 2:
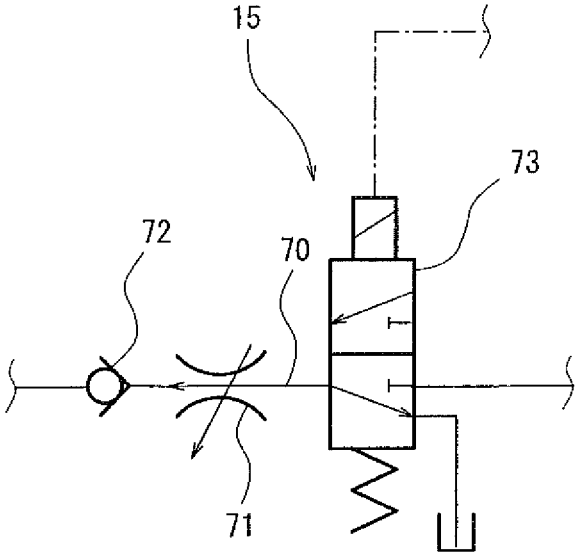
FIG. 2 is a circuit diagram showing in an enlarged manner a merge circuit included in the hydraulic drive system of FIG. 1.

The fan drive circuit 14 configured as described above allows the hydraulic oil flowing through the actuator drive circuit 13 to merge into the hydraulic oil flowing through the fan drive circuit 14 via the merge circuit 15. Specifically, the merge circuit 15 is connected to the fan passage 63. The hydraulic oil flowing through the second bypass passage 54, namely, the hydraulic oil discharged from the actuator pump 11 can be supplied to the fan passage 63 via the merge circuit 15. Now, the configuration of the merge circuit 15 will be described in more detail with reference to FIG. 2.

[Merge Circuit]

The merge circuit 15 includes a merge passage 70 connecting the second bypass passage 54 to the fan passage 63. The merge passage 70 is provided with a variable throttle 71, a check valve 72 and an electromagnetic on-off valve 73. The variable throttle 71 which is a pressure compensation flow rate limiting means is configured to suppress a change in the flow rate of the pressurized oil flowing from the second bypass passage 54 to the fan passage 63, even when a pressure difference in the hydraulic oil between a region upstream of the variable throttle 71 and a region downstream of the variable throttle 71 (namely, pressure difference in the hydraulic oil between the second bypass passage 54 (actuator drive circuit 13) and the fan passage 63 (fan drive circuit 14) changes). Therefore, the variable throttle 71 serves to limit the flow rate of the pressurized oil flowing from the second bypass passage 54 to the fan passage 63, to a predetermined flow rate, and to ensure the flow rate of the pressurized oil which is required for the actuator drive circuit 13. Alternatively, the variable throttle 71 may be a fixed throttle, a sequence valve, or a pressure-reducing valve so long as it is able to limit the flow rate of the pressurized oil flowing from the second bypass passage 54 to the fan passage 63, to a predetermined flow rate, and to ensure the flow rate of the pressurized oil which is required for the actuator drive circuit 13.

The check valve 72 is placed in the merge passage 70 in a location that is downstream of the variable throttle 71. The check valve 72 permits the hydraulic oil to flow from the actuator drive circuit 13 to the fan drive circuit 14 via the merge passage 70 and inhibits the hydraulic oil from flowing from the fan drive circuit 14 to the actuator drive circuit 13 via the merge passage 70. Further, the electromagnetic on-off valve 73 is placed in the merge passage 70 in a location that is upstream of the variable throttle 71.

The electromagnetic on-off valve 73 which is an on-off switch valve is a normally closed electromagnetic on-off valve. The electromagnetic on-off valve 73 is able to open or close the merge passage 70, and connects the second bypass passage 54 and the fan passage 63 to each other or disconnects the second bypass passage 54 and the fan passage 63 from each other, in response to a connection command (current) flowing through the electromagnetic on-off valve 73. In a state in which the connection command is not provided to the electromagnetic on-off valve 73, the electromagnetic on-off valve 73 closes the merge passage 70 and disconnects the second bypass passage 54 and the fan passage 63 from each other, to prevent the hydraulic oil discharged from the actuator pump 11 from being guided to the fan drive circuit 14. In this configuration, the cooling fan motor 19 can be rotated by only the hydraulic oil discharged from the fan pump 61. Thus, the actuator pump 11 can be unloaded while rotating the cooling fan 20.

On the other hand, when the connection command is provided to the electromagnetic on-off valve 73, the electromagnetic on-off valve 73 opens the merge passage 70 and connects the second bypass passage 54 and the fan passage 63 to each other, to guide the hydraulic oil discharged from the actuator pump 11 to the fan drive circuit 14. Thereby, the hydraulic oil discharged from the actuator pump 11 merges into the hydraulic oil discharged from the fan pump 61 in the fan passage 63, and thus the hydraulic oil supplied to the cooling fan motor 19 can be increased. As a result, the maximum rotational speed of the cooling fan 20 can be increased and thus the cooling function of the cooling fan 20 can be enhanced to a higher level, as compared to a case where the cooling fan motor 19 is rotated by only the hydraulic oil discharged from the fan pump 61.

[Sensors]

As shown in FIG. 1, the hydraulic drive system 1 includes sensors (temperature detectors) 75 to 77 for measuring the temperatures of the radiator 26, the oil cooler 27, and the intercooler 28, respectively. More specifically, the water temperature sensor for the radiator (radiator water temperature sensor) 75 is configured to detect the temperature of engine cooling water circulated through the engine E. The oil temperature sensor for the oil cooler (oil cooler temperature sensor) 76 is configured to detect the temperature of the hydraulic oil flowing through the actuator drive circuit 13 and the temperature of the hydraulic oil flowing through the fan drive circuit 14. The sensor for the intercooler (intercooler sensor) 77 is configured to detect the temperature of the compressed air in the interior of the intercooler 28. The engine speed sensor 78 is attached on the output shaft of the engine E. The engine speed sensor 78 is configured to detect the rotational speed of the output shaft of the engine E, namely, engine speed. The sensors 75 to 78 configured in this way are electrically connected to a controller 74, and outputs detection signals to the controller 74.

[Fan Controller]

The controller 74 is configured to control the operations of the components of the hydraulic drive system 1 based on the detection signals received from the sensors 75 to 78. The controller 74 is electrically connected to an operation button 24 and the electromagnetic switch valve 25. The controller 74 is configured to provide a command to the electromagnetic switch valve 25 to operate the electromagnetic switch valve 25, depending on the detection signal of the engine speed sensor 78 and the operated state of the operation button 24. Further, the controller 74 is electrically connected to the electromagnetic on-off valve 73. The controller 74 is configured to provide a connection command to the electromagnetic on-off valve 73 to operate the electromagnetic on-off valve 73.

[Driving Operations of Actuators]

In the hydraulic drive system 1 configured as described above, when the steering or the lever 32, 33 as the operation means is operated, the actuator drive circuit 13 supplies the hydraulic oil to one of the actuators 16 to 18 corresponding to the operation means to drive the corresponding one of the actuators 16 to 18. Now, the driving operations of the actuators will be described in detail.

In the actuator drive circuit 13 of the hydraulic drive system 1, upon the engine E starting to run, the hydraulic oil is discharged from the actuator pump 11 to the main passage 21, and flows to the meter-in compensator 34 and the bleed-off compensator 36 via the steering main passage 41 and the loading device main passage 42, respectively. In a state in which no operation means is operated, that is, the steering and the lever 32, 33 are not operated, the tank line 51 and the communication passage 43 are in communication with each other, in the interior of the spool 35*a*, and the second pilot passage 34*b* is connected to the downstream portion 41*a* of the steering main passage 41. Thus, the meter-in compensator 34 closes the steering main passage 41.

In the bleed-off compensator 36, the pressurized oil with a pressure equal to the first pilot pressure p1 is guided to the third pilot passage 36*a*, and the third pilot pressure p3 becomes equal to the tank pressure. In contrast, the fourth pilot passage 36*b* is connected to the upstream portion 42*a* of the loading device main passage 42, and the fourth pilot pressure p4 becomes equal to the discharge pressure of the actuator pump 11. Because of this, the bleed-off compensator 36 is operated to provide communication between the loading device main passage 42 and the hoist passage 44. The hydraulic oil guided from the actuator pump 11 to the loading device main passage 42 is returned to the tank 12 through the hoist passage 44 and the tank passage 45, and the actuator pump 11 is unloaded. In this unloaded state, the hydraulic oil is guided to the throttle 55, and thus the pressure in the region upstream of the throttle 55 is increased. Therefore, the servo mechanism 56 operates to decrease the tilt angle of the swash plate 11*a*, and the flow rate of the hydraulic oil discharged from the actuator pump 11 is lessened.

In this unloaded state, upon the bucket lever 32 or the hoist lever 33 being operated, the corresponding direction control valve 37, 38 performs switching to change the flow direction of the hydraulic oil, and the corresponding actuator 17, 18 is activated. This causes the bucket or the hoist to be moved.

When the steering is operated to operate the steering device 31, the communication passage 43 is disconnected from the tank line 51 in the interior of the spool 35*a*, namely, the communication passage 43 and the tank 12 are disconnected from each other. However, the communication passage 43 and the downstream portion 41*a* are connected to each other. Therefore, the first and second pilot pressures p1, p2 become substantially equal, and the meter-in compensator 34 is operated to open the steering main passage 41. In contrast, in the bleed-off compensator 36, the pressurized oil with a pressure equal to the first pilot pressure p1 is guided to the third pilot passage 36*a*, and thereby the third pilot pressure p3 is increased. The bleed-off compensator 36 disconnects the upstream portion 42*a* of the loading device main passage 42 and the downstream portion 42*b* of the loading device main passage 42 from each other. Because of this, the hydraulic oil discharged from the actuator pump 11 flows preferentially to the pair of steering actuators 16L, 16R. The steering direction control valve 35 flows the hydraulic oil guided to the steering main passage 41, in a direction corresponding to a steering operation so that the pair of steering actuators 16L, 16R are operated. In this way, the front chassis is bent to a left or to a right, with respect to the rear chassis, and thus, the moving direction of the wheel loader can be changed.

In a case where the steering is operated, the upstream portion 42*a* of the loading device main passage 42 and the downstream portion 42*b* of the loading device main passage 42 are disconnected from each other, so that the oil pressure in the region upstream of the throttle 55 is decreased. Correspondingly, the servo mechanism 56 operates to increase the tilt angle of the swash plate 11*a*, thereby increasing the flow rate of the hydraulic oil discharged from the actuator pump 11. In the actuator drive circuit 13, when the flow rate of the hydraulic oil discharged from the actuator pump 11 reaches a value equal to or higher than the flow rate required to move the steering actuators 16L, 16R, due to, for example, an increase in the flow rate of the hydraulic oil discharged from the actuator pump 11, extra hydraulic oil flows to the loading device main passage 42.

[DPF Regenerating Operation]

Figure 3:
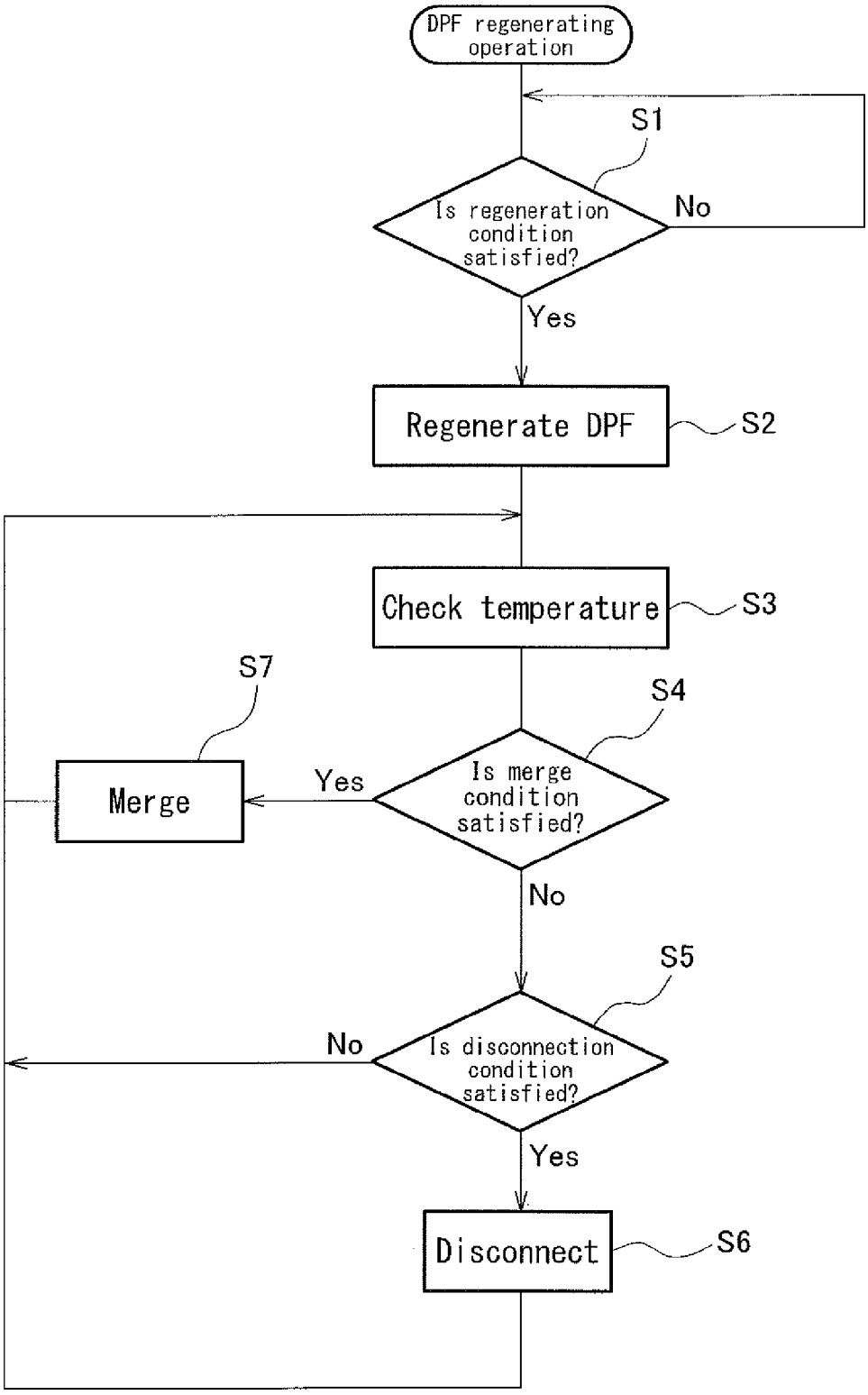
FIG. 3 is a flowchart showing the procedure of a DPF regenerating operation.

The hydraulic drive system 1 is able to increase the load torque of the engine E, in order to remove the particulate matters (hereinafter will be simply referred to as "PM"), such as soot, accumulated inside of a diesel particulate filter (hereinafter will be simply referred to as "DPF") 80 placed inside of a muffler 79 of the engine E. Now, the DPF regenerating operation for removing the PM from the DPF80 will be described with reference to FIG. 3 as well as FIGS. 1 and 2. It is supposed that the fan drive circuit 14 is activated upon the start of the engine E, to rotate the cooling fan 20 to cool the radiator 26, the oil cooler 27, and the intercooler 28, irrespective of whether or not to regenerate the DPF 80.

When the operation button 24 is operated to command the DPF regenerating operation to be performed, in a state in which the engine E is running, the DPF regenerating operation is initiated. Alternatively, the DPF regenerating operation may be initiated, when the filter gets clogged and thereby the controller 74 commands the DPF regenerating operation to be performed, even in a situation in which the operation button 24 is not operated. In response to the command of the DPF regenerating operation, the DPF regenerating operation is initiated and the process moves to step S1.

In step S1 which is a regeneration condition determination step, the controller 74 determines whether or not a regeneration condition is satisfied, based on the detection signals, including the detection signal received from the engine speed sensor 78. In the present embodiment, the regeneration condition is such that the engine speed is equal to or higher than 800 rpm and equal to or lower than 1000 rpm (idling state). Alternatively, the regeneration condition may include the temperature of the engine cooling water, the temperature of the hydraulic oil, the temperature of the compressed air inside of the intercooler 28, etc.. When the controller 74 determines that the regeneration condition is not satisfied, it repeatedly determines whether or not the regeneration condition is satisfied, in step S1. On the other hand, when the controller 74 determines that the regeneration condition is satisfied in step S1, the process moves to step S2.

In step S2 which is a DPF regenerating step, the DPF regenerating operation is executed. In the DPF regenerating operation, the controller 74 provides a command to the electromagnetic switch valve 25, and switches the connection target of the first bypass passage 53 from the communication passage 43 to the second bypass passage 54. Since the connection target of the first bypass passage 53 is switched from the communication passage 43 to the second bypass passage 54, the third and fourth pilot pressures p3, p4 become substantially equal to each other, and the bleed-off compensator 36 operates to disconnect the upstream portion 42*a* of the loading device main passage 42 and the downstream portion 42*b* of the loading device main passage 42 from each other. As a result, the hydraulic oil is not guided to the region upstream of the throttle 55, and the hydraulic pressure in the region upstream of the throttle 55 is decreased. Correspondingly, the servo mechanism 56 increases the tilt angle of the swash plate 11*a*, and increases the flow rate of the hydraulic oil discharged from the actuator pump 11 to a maximum flow rate.

The operation of the steering device 31 is stopped, and thereby the steering main passage 41 is closed. Therefore, the hydraulic oil discharged from the actuator pump 11 cannot be released to the tank 12, the discharge pressure of the actuator pump 11 is increased, and the load torque of the engine E is increased. As a result, the temperature of the exhaust gas emitted from the engine E is increased, and the PM accumulated in the DPF 80 provided inside of the exhaust pipe of the engine E can be removed. When the pressure of the hydraulic oil flowing through the loading device main passage 42 is increased and reaches a value equal to or higher than a predetermined pressure, the loading device relief valve 39 is opened, and the hydraulic oil is discharged from the loading device main passage 42 to the tank 12. This makes it possible to maintain the pressure in the loading device main passage 42 and the discharge pressure at predetermined pressures, and the load torque of the engine E can be controlled at a maximum value. After the DPF regenerating operation has been initiated in the above described manner, the process moves to step S3 while continuing the DPF regenerating operation.

When the engine speed of the engine E does not satisfy the regeneration condition, the DPF regenerating operation is canceled, and the actuator pump 11 is unloaded. When the DPF regenerating operation is cancelled, the process returns to step S1, and the controller 74 determines again whether or not the regeneration operation is satisfied.

In step S3 which is a temperature check step, the controller 74 obtains the temperature of the engine cooling water, the temperature of the hydraulic oil, the temperature of the compressed air, and the temperature of the transmission oil based on the detection signals of the sensors 75 to 77, respectively. After the controller 74 has obtained these temperatures, the process moves to step S4. In step S4 which is a merge condition determination step, the controller 74 determines whether or not a predetermined merge condition is satisfied. Two thresholds which are different from each other (first threshold>second threshold) are set for each of the temperature of the engine cooling water, the temperature of the transmission oil, the temperature of the hydraulic oil, and the temperature of the compressed air. The merge condition includes that at least one of the temperature of the engine cooling water, the temperature of the transmission oil, the temperature of the hydraulic oil, and the temperature of the compressed air, of the above-described four temperatures, exceeds the corresponding first threshold. The first threshold is defined as a temperature at which a failure may occur in the corresponding device, and is arbitrarily set. When the controller 74 determines that the merge condition is not satisfied, the process moves to step S5.

In step S5 which is a disconnection condition determination step, the controller 74 determines whether or not a predetermined disconnection condition is satisfied. The disconnection condition includes a condition in which all of the temperatures which exceed the first thresholds, of the four temperatures, are equal to or lower than the corresponding second thresholds, respectively. The second thresholds are arbitrarily set. When the controller 74 determines that the predetermined disconnection condition is satisfied, the process moves to step S6. In step S6 which is the disconnection step, the controller 74 causes the electromagnetic on-off valve 73 to close the merge passage 70, or maintains a state (namely, closed state) in which the electromagnetic on-off valve 73 closes the merge passage 70, and the process to step S3. Then, in step S3, the controller 74 obtains the temperatures again based on the detection signals of the sensors 75 to 77, and the process moves to step S4. When the controller 74 determines that the merge condition is satisfied in step S4, the process moves to step S7.

In step S7 which is a merge step, the controller 74 provides a connection command to the electromagnetic on-off valve 73 to open the merge passage 70. As a result, the hydraulic oil flowing from the actuator drive circuit 13 is guided to the fan passage 63 through the merge passage 70, and merges into the hydraulic oil discharged from the fan pump 61. Since the hydraulic oil flowing from the actuator drive circuit 13 merges into the hydraulic oil discharged from the fan pump 61 in this way, the flow rate of the hydraulic oil supplied to the cooling fan motor 19 can be increased, the maximum rotational speed of the cooling fan 20 can be increased, and thus the cooling function of the cooling fan 20 can be enhanced to a higher level. In this case, in the merge circuit 15, the variable throttle 71 limits the flow of the hydraulic oil flowing through the merge passage 70 to ensure the flow rate of the hydraulic oil required for the actuator drive circuit 13. This makes it possible to increase the maximum rotational speed of the cooling fan 20 and enhance the cooling function to a higher level, while allowing the actuator drive circuit 13 to perform the function (DPF regeneration by load application to the engine E). As a result, the cooling capability of the radiator 26, the cooling capability of the oil cooler 27, and the cooling capability of the intercooler 28 can be improved, and failures in these devices can be prevented.

In a conventional DPF regenerating operation, to apply a load to the engine E, the actuator pump 11 discharges the hydraulic oil and the loading device relief valve 39 discharges the hydraulic oil to the tank 12. Since the loading device relief valve 39 discharges the hydraulic oil, wasteful heat energy is generated. In contrast, in the DPF regenerating operation of the present invention, since the hydraulic oil discharged from the actuator pump 11 merges into the hydraulic oil flowing through the fan drive circuit 14, a part of the energy discharged wastefully as heat energy can be efficiently utilized as energy for driving the cooling fan 20. This can reduce an energy loss. In other words, since a part of the energy is efficiently utilized as the energy for driving the cooling fan 20, energy required to regenerate the DPF and cool the devices can be reduced.

When the maximum rotational speed of the cooling fan 20 is increased in step S7, the process returns to step S3, and the controller 74 obtains the temperatures again based on the detection signals of the sensors 75 to 77 in step S3, and determines whether or not the merge condition is satisfied in step S4. When the temperatures are decreased due to an increase in the maximum rotational speed of the cooling fan 20, and the controller 74 determines that the merge condition is not satisfied in step S4 and further determines that the disconnection condition is not satisfied in step S5, the process returns to step S3. At this time, the controller 74 continues to maintain the opened or closed state of the merge passage 70. Specifically, in the opened state of the merge passage 70, the controller 74 continues to provide a connection command to the electromagnetic on-off valve 73 to maintain the opened state of the merge passage 70. On the other hand, in the closed state of the merge passage 70, the controller 74 does not provide a connection command to the electromagnetic on-off valve 73 to maintain the closed state of the merge passage 70.

When the process returns to step S3, the controller 74 obtains the temperatures again based on the detection signals of the sensors 75 to 77 in step S3, and determines whether or not the merge condition is satisfied in step S4. When the controller 74 determines that the merge condition is not satisfied in step S4 and further determines that the disconnection condition is satisfied in step S5, the process moves to step S6. In step S6, the controller 74 stops providing the connection command to the electromagnetic on-off valve 73 to close the merge passage 70. Thereby, the supply of the hydraulic oil from the actuator drive circuit 13 to the fan drive circuit 14 is stopped, and the maximum rotational speed of the cooling fan 20 is decreased. This makes it possible to prevent a situation in which the radiator 26, the oil cooler 27 and the intercooler 28 are excessively cooled, and as a result, their operation performances are degraded. Since the two different thresholds (i.e., hysteresis) are set as described above, it becomes possible to prevent the opened or closed state of the merge passage 70 from being changed promptly.

In the hydraulic drive system 1 configured as described above, it becomes possible to suppress an increase in the temperature of the cooling medium in the radiator 26, an increase in the temperature of the cooling medium in the oil cooler 27, and an increase in the temperature of the compressed air inside of the intercooler 28 during the DPF regenerating operation, and to properly regenerate the DPF. In addition, in the hydraulic drive system 1, the merge circuit 15 can be realized with fewer components than in an embodiment which will be described later.

[Embodiment 2]

The configuration of a hydraulic drive system 1A of Embodiment 2 is similar to the configuration of the hydraulic drive system 1 of Embodiment 1. Hereinafter, regarding the configuration of the hydraulic drive system 1A of Embodiment 2, only differences from the configuration of the hydraulic drive system 1 of Embodiment 1 will be described, and the same components are designated by the same reference symbols and will not be described repeatedly, in some cases. The same applies to a hydraulic drive system 1B of Embodiment 3 which will be described later.

Figure 4:
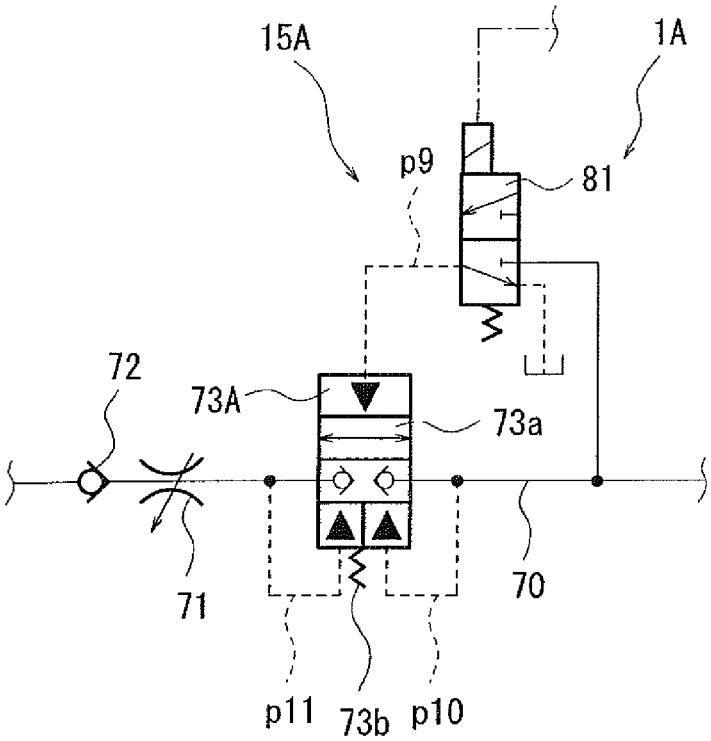
FIG. 4 is a circuit diagram showing in an enlarged manner a merge circuit included in a hydraulic drive system according to Embodiment 2 of the present invention.

As shown in FIG. 4, the hydraulic drive system 1A of Embodiment 2 includes the actuator drive circuit 13, the fan drive circuit 14, and a merge circuit 15A. The merge circuit 15A includes the variable throttle 71, the check valve 72, a logic valve 73A, and an electromagnetic control valve 81. The logic valve 73A which is an on-off switch valve is placed on the merge passage 70 in a location that is upstream of the variable throttle 71. A pilot pressure p9 is applied to a valving element 73*a* of the logic valve 73A. An upstream pressure p10 of the logic valve 73A, a downstream pressure p11 of the logic valve 73A, and a biasing force of the spring 73*b* act against the pilot pressure p9. The valving element 73*a* opens or closes the merge passage 70 depending on a balance among these forces. The electromagnetic control valve 81 is connected to the merge passage 70 in a location that is upstream of the logic valve 73A, while the downstream portion of the electromagnetic control valve 81 is connected to the logic valve 73A.

The electromagnetic control valve 81 is electrically connected to the controller 74. The electromagnetic control valve 81 uses as a pressure source, the pressure of the hydraulic oil flowing through the merge passage 70. The electromagnetic control valve 81 outputs to the logic valve 73A, the hydraulic oil flowing through the merge passage 70 as the pilot pressure p9. Alternatively, in Embodiment 3, as the pressure source of the electromagnetic control valve 81, a pilot pump 82 which will be described later, may be used.

Since the hydraulic drive system 1A configured as described above uses the logic valve 73A, manufacturing cost can be reduced as compared to a case where the electromagnetic on-off valve 73 is used. In addition, since the electromagnetic control valve 81 may be a valve having a lower pressure resistance than the electromagnetic on-off valve 73, manufacturing cost can be reduced.

Moreover, the hydraulic drive system 1A drives the actuators, regenerates the DPF and achieves the advantages as in the hydraulic drive system 1 of Embodiment 1, except that the logic valve 73A is operated when the hydraulic oil is merged.

[Embodiment 3]

Figure 5:
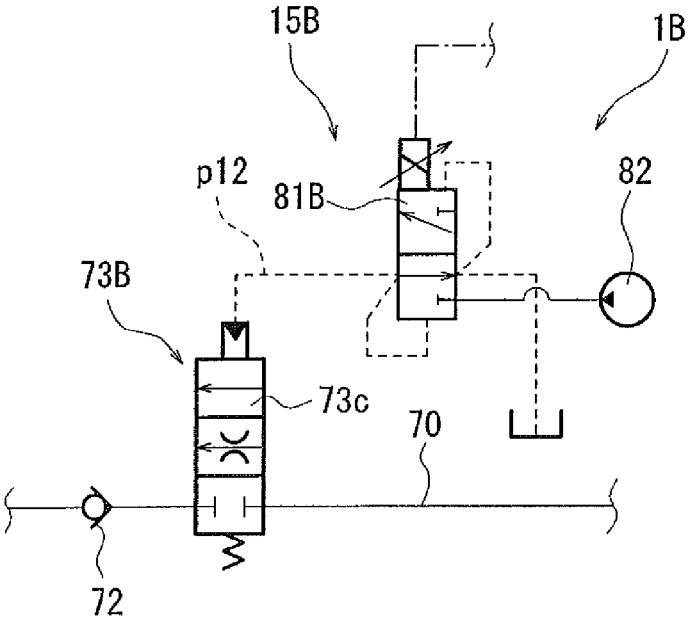
FIG. 5 is a circuit diagram showing in an enlarged manner a merge circuit included in a hydraulic drive system according to Embodiment 3 of the present invention.

As shown in FIG. 5, a hydraulic drive system 1B of Embodiment 3 includes the actuator drive circuit 13, the fan drive circuit 14, and a merge circuit 15B. The merge circuit 15B includes the check valve 72, a spool valve 73B, a pilot pump 82, and an electromagnetic control valve 81B. The spool valve 73B is placed on the merge circuit 15B in a location that is upstream of the check valve 72. The spool valve 73B includes a spool 73*c*. The spool 73*c* moves to a position corresponding to a pilot pressure p12 applied to the spool 73*c*. The spool valve 73B adjusts the opening degree of the merge passage 70 into one corresponding to the position of the spool 73*c*. Because of this, the spool valve 73B is capable of adjusting the flow rate of the hydraulic oil to be merged, as well as performing the function of the on-off switch valve. In this configuration, the maximum rotational speed of the cooling fan 20 can be increased, while allowing the actuator drive circuit 13 to perform the function, as in the hydraulic drive system 1 of Embodiment 1 and the hydraulic drive system 1A of Embodiment 2.

The pilot pump 82 is a fixed displacement pump with a low flow rate, and is configured to discharge pilot oil to the electromagnetic control valve 81B. The electromagnetic control valve 81B is electrically connected to the controller 74, and uses the pilot pump 82 as a pressure source. The electromagnetic control valve 81B adjusts the pressure of the pilot oil to a pressure corresponding to a connection command output from the controller 74, and outputs this pressure as a pilot pressure p12 to the spool valve 73B. Alternatively, the pressure source of the electromagnetic control valve 81B may be the pressure of the hydraulic oil flowing through the merge passage 70 as described in Embodiment 2.

Since the hydraulic drive system 1B configured as described above uses the spool valve 73B, manufacturing cost can be reduced as compared to a case where the electromagnetic on-off valve 73 is used. In addition, since the pressurized liquid discharged from the pilot pump 82 is the pilot pressure source, the electromagnetic control valve 81B may be a valve having a lower pressure resistance, and thus, manufacturing cost can be reduced.

Moreover, the hydraulic drive system 1B drives the actuators, regenerates the DPF and achieve the advantages as in the hydraulic drive system 1 of Embodiment 1, except that the spool 73B is operated when the hydraulic oil is merged.

[Other Embodiments]

Although the hydraulic drive systems 1, 1A, 1B of Embodiment 1 to Embodiment 3 are configured to increase the maximum rotational speed of the cooling fan 20, in the DPF regenerating operation, these systems may increase the maximum rotational speed of the cooling fan 20, in an operation other than the DPF regenerating operation. For example, when one of the four temperatures (the temperature of the engine cooling water, the temperature of the hydraulic oil, the temperature of the compressed air, and the temperature of the transmission oil) exceeds the corresponding first threshold, under the idling state, the maximum rotational speed of the cooling fan 20 may be increased.

Although the actuator pump 11 of the actuator drive circuit 13 is the variable displacement pump, it may be the fixed displacement pump.

Although the hydraulic drive systems 1, 1A, 1B of Embodiment 1 to Embodiment 3 are configured to determine whether or not to merge the hydraulic oil, based on one of the temperature of the engine cooling water, the temperature of the hydraulic oil, the temperature of the compressed air, and the temperature of the transmission oil, these systems may be configured to determine whether or not to merge the hydraulic oil, depending on only whether or not to regenerate the DPF. Specifically, the controller 74 may be configured to cause the hydraulic oil flowing through the actuator drive circuit 13 to merge into the hydraulic oil flowing through the fan drive circuit 14, in a case where the DPF is regenerated. Moreover, the above-described first threshold and second threshold are merely exemplary, and may be set according to user' uses.

Although the hydraulic drive systems 1, 1A, 1B of Embodiment 1 to Embodiment 3 are configured such that the merge circuits 15, 15A, 15B are applied to the actuator drive circuit 13, the configuration of the actuator drive circuit 13 is not limited to the above-described configuration so long as the actuator drive circuit 13 is capable of driving the steering and the actuators and of regenerating the DPF.

Although the hydraulic drive systems 1, 1A, 1B of Embodiment 1 to Embodiment 3 use the pressurized oil as pressurized liquid, the liquid used as the pressurized liquid may be water, etc. Although the hydraulic drive systems 1, 1A, 1B of Embodiment 1 to Embodiment 3 are incorporated into the wheel loader, the construction machine into which the hydraulic drive systems 1, 1A, 1B of Embodiment 1 to Embodiment 3 are incorporated is not limited to the wheel loader, but may be other construction machines such as a bulldozer or a shovel car.

Numeral improvements and alternative embodiments of the present invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

REFERENCE SIGNS LIST

1, 1A, 1B hydraulic drive system
11 actuator pump
13 actuator drive circuit
14 fan drive circuit
15, 15A, 15B merge circuit
16L steering actuator
16R steering actuator
17 bucket actuator
18 hoist actuator
19 cooling fan motor
20 cooling fan
24 operation button
26 radiator
27 oil cooler
28 intercooler
29 supercharger
61 fan pump
70 merge passage
71 variable throttle
72 check valve
73 electromagnetic on-off valve
73A logic valve
73B spool valve
74 controller
75 radiator water temperature sensor
76 oil cooler oil temperature sensor
77 intercooler sensor
78 engine speed sensor
81, 81B electromagnetic control valve
82 pilot pump

The invention claimed is:

1. A liquid-pressure drive system comprising:

a first liquid-pressure pump which discharges pressurized liquid;

an actuator drive circuit which causes the pressurized liquid discharged from the first liquid-pressure pump to flow to an actuator to drive the actuator;

a liquid-pressure motor which rotates a cooling fan at a rotational speed corresponding to a flow rate of the pressurized liquid supplied to the liquid-pressure motor;

a second liquid-pressure pump which discharges the pressurized liquid in response to an operation of the first liquid-pressure pump;

a fan drive circuit which causes the pressurized liquid discharged from the second liquid-pressure pump to flow to the liquid-pressure motor to drive the liquid-pressure motor;

a merge circuit which performs switching to connect the actuator drive circuit and the fan drive circuit to each other or to disconnect the actuator drive circuit and the fan drive circuit from each other, and causes the pressurized liquid flowing through the actuator drive circuit to merge into the pressurized liquid flowing though the fan drive circuit in a state in which the actuator drive circuit and the fan drive circuit are connected to each other; and a controller which controls the merge circuit to connect the actuator drive circuit and the fan drive circuit to each other when a predetermined merge condition is satisfied, wherein the merge circuit includes an on-off switch valve, and a variable throttle, wherein the controller outputs a connection command depending on whether the predetermined merge condition is satisfied, wherein the on-off switch valve performs switching to connect the actuator drive circuit and the fan drive circuit to each other or to disconnect the actuator drive circuit and the fan drive circuit from each other, in response to the connection command received from the controller, and wherein the variable throttle limits the flow rate of the pressurized liquid which flows from the actuator drive circuit into the fan drive circuit such that the pressurized liquid flowing through the actuator drive circuit merges into the pressurized liquid flowing through the fan drive circuit, while ensuring a predetermined flow rate of the pressurized liquid flowing though the actuator drive circuit.

2. The liquid-pressure drive system according to claim 1, wherein the on-off switch valve is an electromagnetic on-off valve which performs switching to connect the actuator drive circuit and the fan drive circuit to each other or to disconnect the actuator drive circuit and the fan drive circuit from each other, in response to the connection command.

3. The liquid-pressure drive system according to claim 1, further comprising:

an electromagnetic control valve which outputs a pilot pressure in response to the connection command, wherein the on-off switch valve is a logic valve or a spool valve which performs switching to connect the actuator drive circuit and the fan drive circuit to each other or to disconnect the actuator drive circuit and the fan drive circuit from each other, in response to the pilot pressure output from the electromagnetic control valve.

4. The liquid-pressure drive system according to claim 3, wherein a pressure source of the pilot pressure is the pressurized liquid flowing through the actuator drive circuit.

5. The liquid-pressure drive system according to claim 3, wherein a pressure source of the pilot pressure is the pressurized liquid discharged from a pilot pump, and wherein a discharge pressure of the pilot pump is lower than a discharge pressure of the first liquid-pressure pump.

6. The liquid-pressure drive system according to claim 1, comprising:

a temperature detector which detects a temperature of a cooled target to be cooled by the cooling fan, wherein the controller is configured to determine that the merge condition is satisfied when the temperature detected by the temperature detector exceeds a first predetermined temperature.

7. The liquid-pressure drive system according to claim 6, wherein the controller is configured to determine that the merge condition is not satisfied and disconnects the actuator drive circuit and the fan drive circuit from each other when the temperature detected by the temperature detector is decreased from the first predetermined temperature to a value which is equal to or lower than a second predetermined temperature.

8. A construction machine comprising:

at least one cooled target;

a cooling fan configured to cool the at least one cooled target with moving air; and a liquid pressure drive system whose liquid pressure motor rotates the cooling fan, the liquid pressure drive system comprising:

a first liquid-pressure pump which discharges pressurized liquid;

an actuator drive circuit which causes the pressurized liquid discharged from the first liquid-pressure pump to flow to an actuator to drive the actuator;

the liquid-pressure motor which rotates the cooling fan at a rotational speed corresponding to a flow rate of the pressurized liquid supplied to the liquid-pressure motor;

a second liquid-pressure pump which discharges the pressurized liquid in response to an operation of the first liquid-pressure pump;

a fan drive circuit which causes the pressurized liquid discharged from the second liquid-pressure pump to flow to the liquid-pressure motor to drive the liquid-pressure motor;

a merge circuit which performs switching to connect the actuator drive circuit and the fan drive circuit to each other or to disconnect the actuator drive circuit and the fan drive circuit from each other, and causes the pressurized liquid flowing through the actuator drive circuit to merge into the pressurized liquid flowing though the fan drive circuit in a state in which the actuator drive circuit and the fan drive circuit are connected to each other; and a controller which controls the merge circuit to connect the actuator drive circuit and the fan drive circuit to each other when a predetermined merge condition is satisfied, wherein the merge circuit includes an on-off switch valve, and a variable throttle, wherein the controller outputs a connection command depending on whether or not the predetermined merge condition is satisfied, wherein the on-off switch valve performs switching to connect the actuator drive circuit and the fan drive circuit to each other or to disconnect the actuator drive circuit and the fan drive circuit from each other, in response to the connection command received from the controller, and wherein the variable throttle limits the flow rate of the pressurized liquid which flows from the actuator drive circuit into the fan drive circuit such that the pressurized liquid flowing through the actuator drive circuit merges into the pressurized liquid flowing through the fan drive circuit, while ensuring a predetermined flow rate of the pressurized liquid flowing though the actuator drive circuit.

* * * * *